US010524555B1

(12) United States Patent
Hwang

(10) Patent No.: US 10,524,555 B1
(45) Date of Patent: Jan. 7, 2020

(54) REFILLABLE COSMETIC CONTAINER

(71) Applicant: F.S.KOREA INDUSTRIES INC., Seoul (KR)

(72) Inventor: Jae Kwang Hwang, Seoul (KR)

(73) Assignee: F.S.KOREA INDUSTRIES INC., Seoul (KR)

( * ) Notice: Subject to any disclaimer, the term of this patent is extended or adjusted under 35 U.S.C. 154(b) by 0 days.

(21) Appl. No.: 16/127,010

(22) Filed: Sep. 10, 2018

(51) Int. Cl.

| | |
|---|---|
| ***A45D 33/16*** | (2006.01) |
| ***A45D 34/04*** | (2006.01) |
| *A45D 34/00* | (2006.01) |
| *A45D 33/00* | (2006.01) |

(52) U.S. Cl.
CPC ..... *A45D 34/04* (2013.01); *A45D 33/16* (2013.01); *A45D 2033/001* (2013.01); *A45D 2034/002* (2013.01)

(58) Field of Classification Search
CPC .. A45D 34/04; A45D 33/16; A45D 2033/001; A45D 2034/002; A45D 40/24; A45D 40/0068; A45D 2040/0006
See application file for complete search history.

(56) References Cited

U.S. PATENT DOCUMENTS

| | | | | |
|---|---|---|---|---|
| 5,746,530 | A * | 5/1998 | Oota | A45D 40/06 401/63 |
| 6,012,864 | A * | 1/2000 | Asami | B43K 7/08 401/142 |
| 8,177,452 | B2 * | 5/2012 | Tsai | A45D 34/042 401/204 |
| 9,210,985 | B2 * | 12/2015 | Arwatz | A45D 34/04 |
| 10,046,348 | B2 * | 8/2018 | Brugger | B05B 11/0032 |

* cited by examiner

*Primary Examiner* — Frederick C Nicolas
(74) *Attorney, Agent, or Firm* — Heedong Chae; Lucem, PC

(57) ABSTRACT

Disclosed is a refillable cosmetic container which includes a container main body including a container body having upper and lower openings and a cosmetic discharging member provided at the lower side of the container body and provided as a discharge passage of cosmetics, a main body cap detachably coupled to the container main body in a region where the cosmetic discharging member is provided, a refill container portion detachably coupled to the container main body and storing cosmetics therein, and an insertion guide portion provided on the other side of the container body to guide the insertion of the refill container portion.

11 Claims, 12 Drawing Sheets

REFILLABLE COSMETIC CONTAINER

BACKGROUND OF THE INVENTION

Field of the Invention

The present invention relates to a refillable cosmetic container, and more particularly, to a refillable cosmetic container which can be conveniently used by simplifying a refill structure.

Description of the Related Art

In general, a variety of refilling products that allow consumers to purchase and use products at low prices have been released.

Refilling products may be used by replenishing the contents to a refined container, and by replacing an inner container containing the contents with an outer container.

Examples of representative products that are be used by replenishing the contents to the refined container may include bathing articles, detergents, and the like, and examples of products which are used by refilling an inner container containing the contents with an outer container may include cosmetics.

While one container may be formed by refilling the inner container with the outer container, lotions or skins as basic cosmetics that need to maintain cleanliness can be refilled and used by refilling and using the inner container with the outer container.

In addition, the design of the outer container is changed freely, so that there is an advantage that an image of the product may be always appealed to the consumers and relatively expensive cosmetics may be provided to the consumers at a low price.

On the other hand, since previous refillable cosmetic containers are inconvenient to use and increased in manufacturing cost due to a complicated refill structure, improvement measures are required.

The above-described technical configuration is a background technique for assisting the understanding of the present invention, and does not mean a conventional technology widely known in the art to which the present invention belongs.

SUMMARY OF THE INVENTION

Therefore, an object of the present invention is to provide a refillable cosmetic container which can be conveniently used by simplifying the refill structure.

According to an aspect of the present invention, there is provided a refillable cosmetic container including: a container main body including a container body having upper and lower openings and a cosmetic discharging member provided at the lower side of the container body and provided as a discharge passage of cosmetics; a main body cap detachably coupled to the container main body in a region where the cosmetic discharging member is provided; a refill container portion detachably coupled to the container main body and storing cosmetics therein; and an insertion guide portion provided on the other side of the container body to guide the insertion of the refill container portion, in which the insertion guide portion includes an insertion guide body provided at the other side of the container body, at least one insertion groove provided on the inner wall of the upper end of the insertion guide body to guide the insertion of a stopper rod of the refill container portion, a first insertion hole provided in the guide body to be coupled to at least one insertion groove to guide the insertion of the stopper rod, and a second insertion hole provided in the guide body to extend from the first insertion hole to fix the inserted stopper rod.

According to another aspect of the present invention, there is provided a refillable cosmetic container including: a container main body including a container body having upper and lower openings and a cosmetic discharging member provided at the lower side of the container body and provided as a discharge passage of cosmetics; a main body cap detachably coupled to the container main body in a region where the cosmetic discharging member is provided; a refill container portion detachably coupled to the container main body and storing cosmetics therein; and an insertion guide portion provided on the other side of the container body to guide the insertion of the refill container portion, in which the insertion guide portion includes an insertion guide body provided at the other side of the container body, at least one insertion hole provided on the inner wall of the upper end of the insertion guide body to guide the insertion of a stopper rod of the refill container portion, a first insertion hole provided in the guide body to be coupled to at least one insertion hole to guide the insertion of the stopper rod, and a second insertion hole provided in the guide body to extend from the first insertion hole to fix the inserted stopper rod, and a pair of guide posts guiding the refill container portion to be inserted to the insertion guide portion is at least one provided in the support cap of the container main body.

The first insertion hole may be inclined with respect to the insertion guide body, and the second insertion hole may be provided to be perpendicular to the insertion guide body.

The refill container portion may include: a refill container body in which cosmetics are stored; a refill container cap which is detachably coupled to one side of the refill container body and has a stopper rod provided on the outer wall; a pump inner cap coupled to the other side of the refill container body; a pump housing coupled to the pump inner cap; a stem of which one side is coupled to a connector member provided in the container body and the other side is supported to the pump housing; and a spring of which one side is supported to the stem and the other side is supported to the pump housing.

The main body cap may include a cap boy detachably coupled to the container body; and a sealing cap provided on the inner wall of the cap body and fitted with the end portion of the cosmetic discharging member.

The container main body may further include a support cap detachably coupled to the insertion guide body to surround the refill container cap.

The pair of guide posts may be provided on the inner wall body of the support cap, and a support wall extending from one of the pair of guide posts to support a fastening portion of the insertion guide portion may be provided in the inner wall body.

The pair of guide posts may be provided at a position facing the at least one insertion hole.

A stopper protrusion stopping a stopper rod provided in the refill container portion may be provided in the first insertion hole.

According to the embodiments of the present invention, it is possible to conveniently use a refill container portion by an insertion guide portion provided with an insertion guide body, an insertion groove, a first insertion hole and a second insertion hole.

Further, it is possible to conveniently use the refill container portion by an insertion guide portion provided with an insertion guide body, an insertion groove, a first insertion hole and a second insertion hole.

Furthermore, it is possible to conveniently and stably guide the refill container portion to the insertion guide portion by at least one of a pair of guide posts provided on a support cap.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
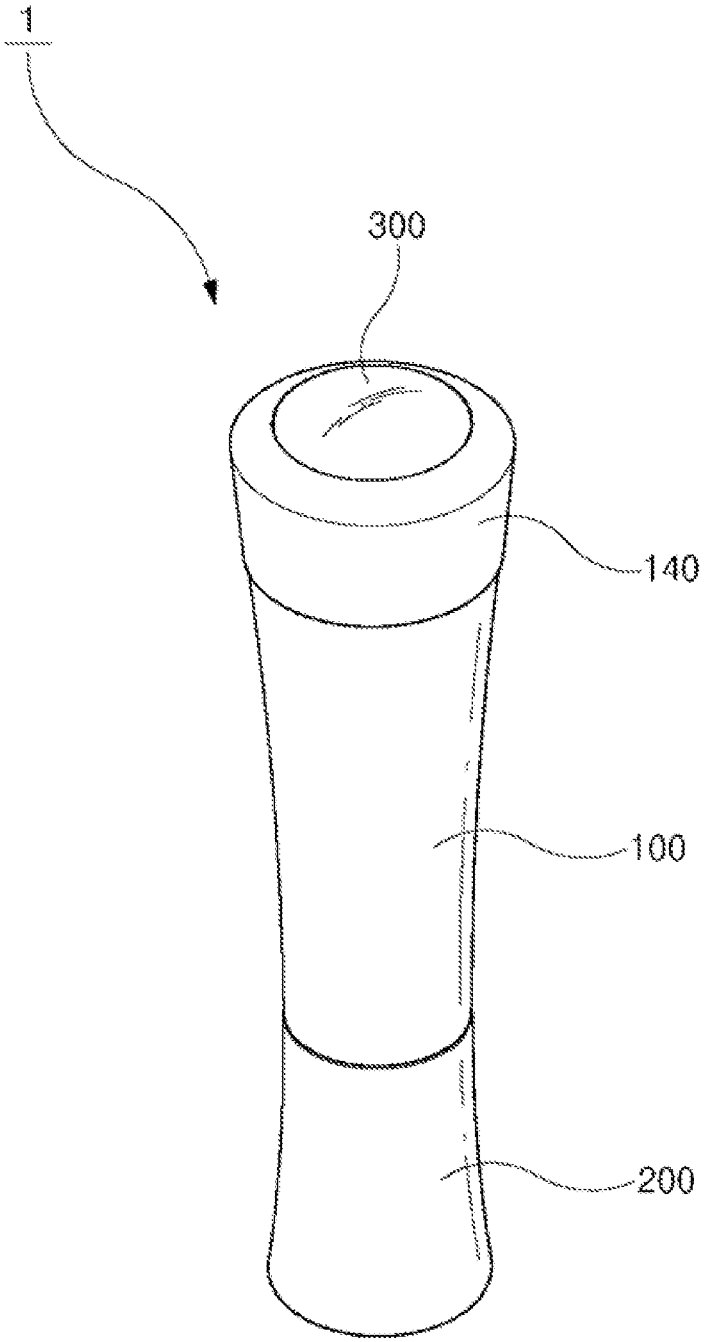
FIG. 1 is a perspective view showing a refillable cosmetic container according to an embodiment of the present invention.

In order to fully understand the present invention, operational advantages of the present invention and objects achieved by implementing the present invention, the prevent invention will be described with reference to the accompanying drawings which illustrate preferred embodiments of the present invention and the contents illustrated in the accompanying drawings.

Hereinafter, preferred exemplary embodiments of the present invention will be described in detail with reference to the accompanying drawings. Like reference numerals illustrated in the respective drawings designate like members.

Figure 2:
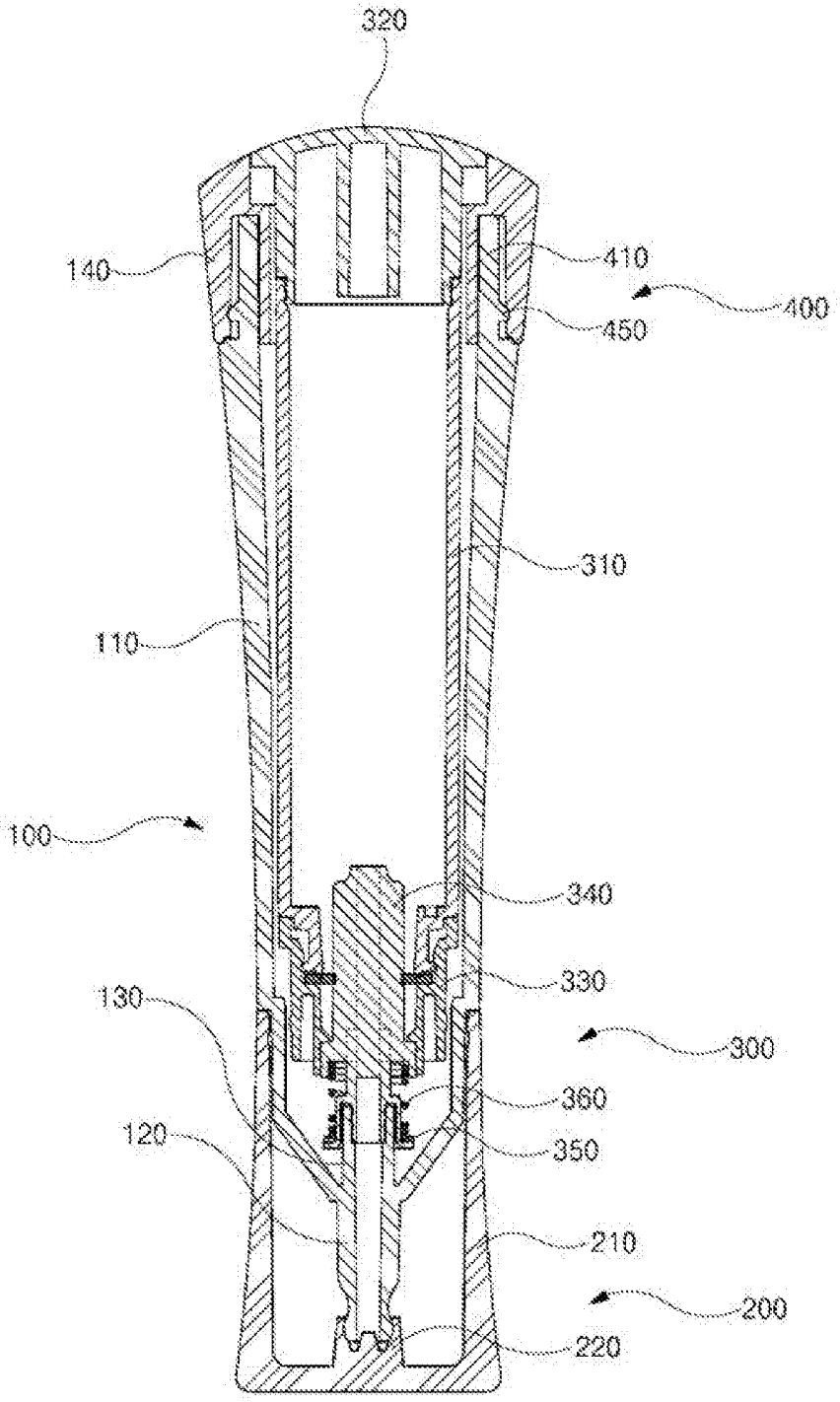
FIG. 2 is a cross-sectional view of FIG. 1.
Figure 3:
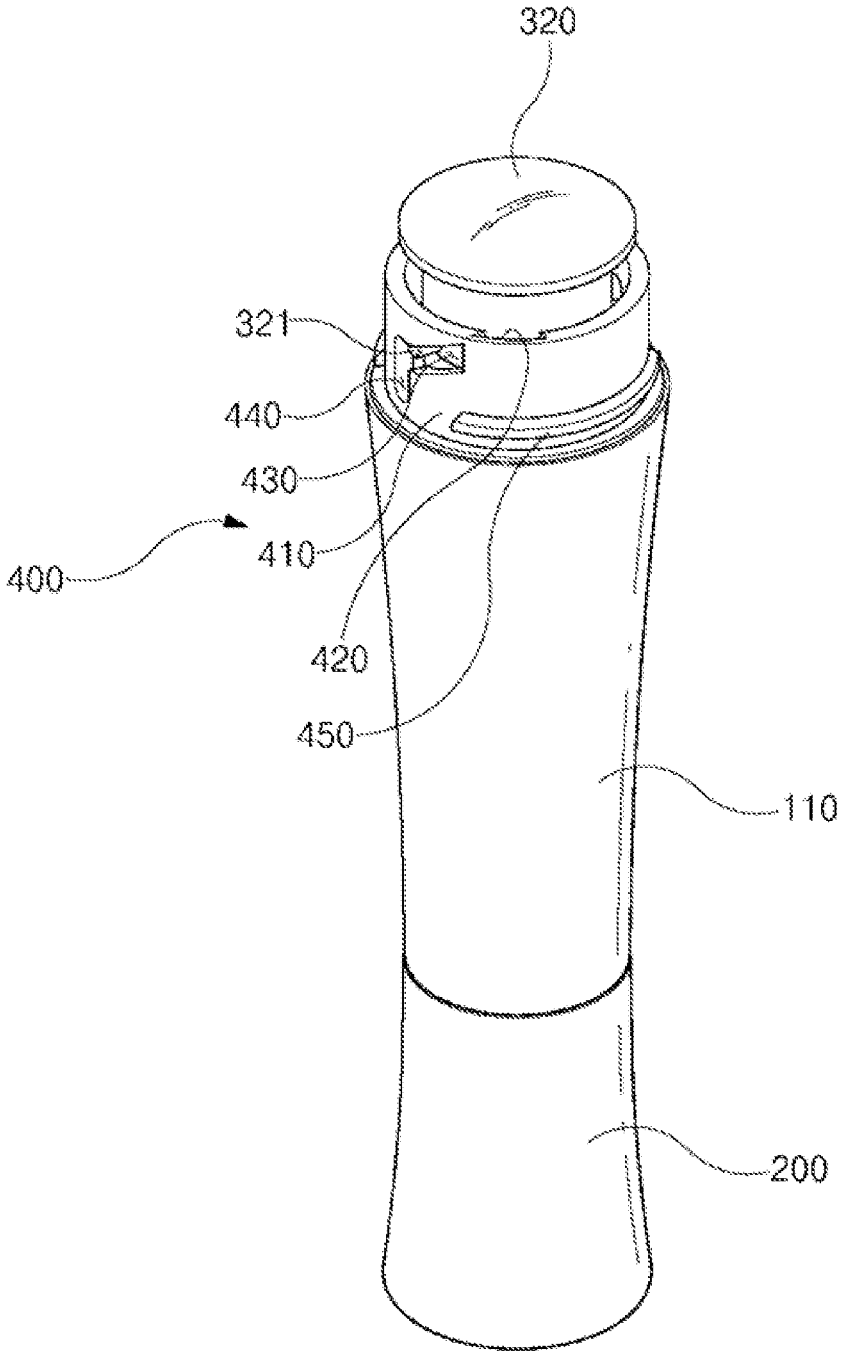
FIG. 3 is a perspective view showing a state in which a support cap is removed in FIG. 1.
Figure 4:
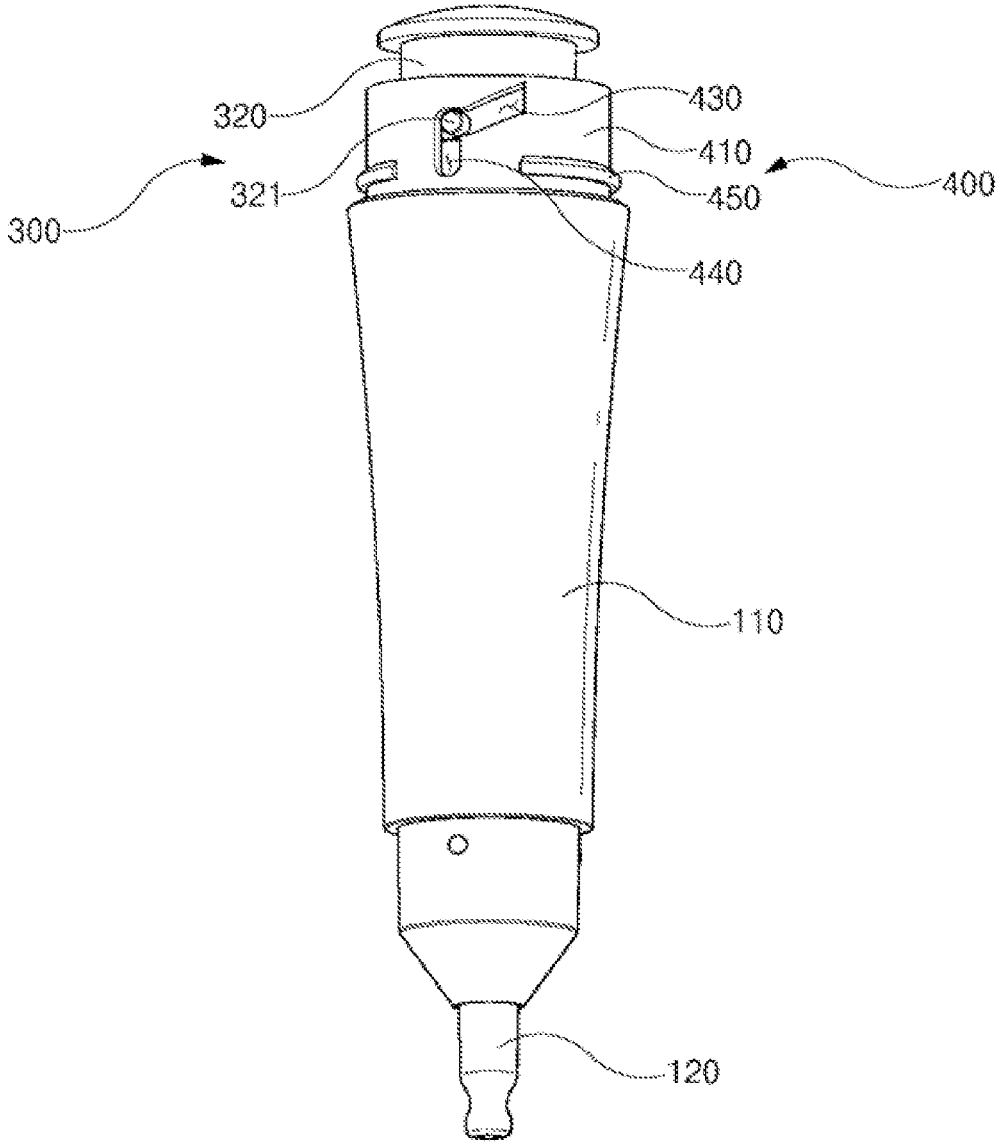
FIG. 4 is a perspective view showing a state in which a main body caps is removed in FIG. 3.
Figure 5:
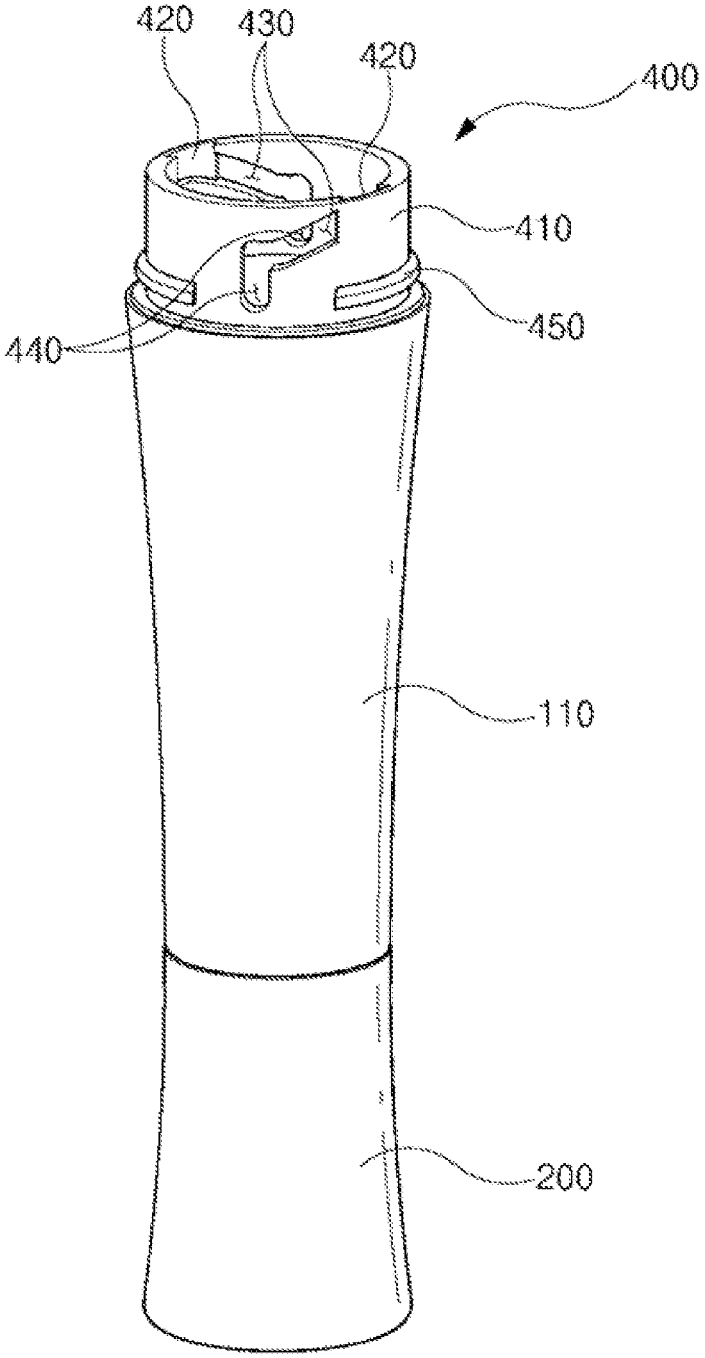
FIG. 5 is a perspective view showing a state in which a refill container portion is removed in FIG. 3.
Figure 6:
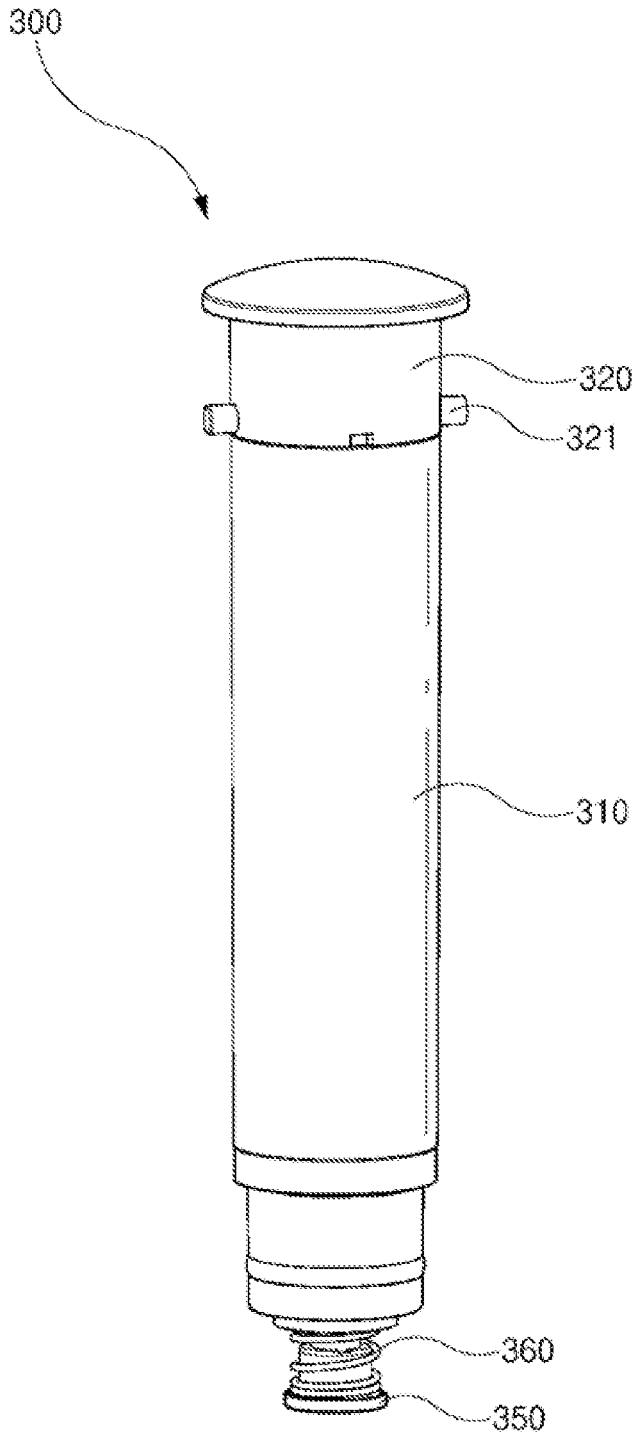
FIG. 6 is a perspective view showing the refill container portion shown in FIG. 3.

FIG. 1 is a perspective view showing a refillable cosmetic container according to an embodiment of the present invention, FIG. 2 is a cross-sectional view of FIG. 1, FIG. 3 is a perspective view showing a state in which a support cap is removed in FIG. 1, FIG. 4 is a perspective view showing a state in which a main body cap is removed in FIG. 3, FIG. 5 is a perspective view showing a state in which a refill container portion is removed in FIG. 3, and FIG. 6 is a perspective view showing the refill container portion shown in FIG. 3.

As shown in these drawings, a refillable cosmetic container 1 according to the present embodiment includes a container main body 100, a main body cap 200 detachably coupled to the container main body 100, a refill container portion 300 detachably coupled to container main body 100 and storing cosmetics therein, and an insertion guide portion 400 provided on the other side of a container body 110 to guide the insertion of the refill container portion 300.

As shown in FIG. 2, the container main body 100 includes a container body 110 having upper and lower openings, a cosmetic discharging member 120 provided at the lower side of the container body 110 and provided as a discharge passage of cosmetics, a connector member 130 which is provided inside the container body 110 in a region where the cosmetic discharging member 120 is provided and provided as a coupling place of a stem 350, and a support cap 140 which is detachably coupled to the insertion guide body 410 to surround the refill container cap 320.

The container body 110 of the container main body 100 may be provided in a circular shape elongated in a longitudinal direction as shown in FIG. 1.

The cosmetic discharging member 120 of the container main body 100 may be fitted to a sealing cap to be sealed and fixed as shown in FIG. 2.

The support cap 140 of the container main body 100 may be screwed to a thread 450 provided on the outer wall of the insertion guide body 410 shown in FIG. 5.

As shown in FIG. 2, the main body cap 200 includes a cap body 210 detachably fitted to a lower portion of the container body 110 by protrusions and grooves, and a sealing cap 220 provided on the inner wall of the cap body 210 to fix and seal the end portion of the cosmetic discharging member 120.

In the present embodiment, the lower portion of the cap body 210 may be provided flatly, as shown in FIG. 2, so that the present embodiment may be vertically erected.

As shown in FIG. 2, the refill container portion 300 is coupled to the container main body 100 and the cosmetics stored in the refill container portion 300 may be discharged to the outside of the container main body 100 through the cosmetic discharging member 120.

In the present embodiment, the refill container portion 300 may be easily inserted into the container body 110 through the insertion guide unit 400 shown in FIG. 5 and the inserted position may be stably maintained.

In the present embodiment, as shown in FIG. 2, the refill container portion 300 includes a refill container body 310 in which the cosmetics are stored, a refill container cap 320 which is detachably coupled to an upper portion of the refill container body 310 and has a stopper rod 321 provided on the outer wall, a pump inner cap 330 coupled to a lower portion of the refill container body 310; a pump housing 340 coupled to the pump inner cap 330; a stem 350 of which a lower portion is coupled to a connector member provided in the container body 110 and an upper portion is supported to the pump housing 340, and a spring 360 of which a lower portion is supported to the stem 350 and an upper portion is supported to the pump housing 340.

As shown in FIG. 6, a pair of stopper rods 321 of the refill container portion 300 may be provided to be spaced apart from each other, and may be sequentially inserted to the first insertion hole 430 and the second insertion hole 440 through the insertion groove 420 shown in FIG. 5.

The refill container cap 320 of the refill container portion 300 may be detachably screwed or fitted to the refill container body 310.

The pump inner cap 330 of the refill container portion 300 may be detachably screwed or fitted to the refill container body 310 or may be integrally formed with the refill container body 310.

The pump housing 340 of the refill container portion 300 may be detachably screwed or fitted to the inner wall of the pump inner cap 330.

As shown in FIG. 5, the insertion guide portion 400 is provided at the upper portion of the container body 110 and serves to guide the movement of the refill container portion 300 when the refill container portion 300 is inserted into or withdrawn from the container body 110.

In the present embodiment, as shown in FIG. 5, the insertion guide portion 400 includes an insertion guide body 410 provided at the upper portion of the container body 110, a pair of insertion grooves 420 provided on the inner wall of the upper end of the insertion guide body 410 to guide the insertion of the stopper rod 321 of the refill container portion 300, a pair of first insertion holes 430 provided in the guide body to be coupled to the pair of insertion grooves 420 to guide the insertion of the stopper rod 321, and a second insertion hole 440 provided in the guide body to extend from the first insertion hole 430 to fix the inserted stopper rod 321.

In the present embodiment, as shown in FIG. 5, the first insertion hole 430 is inclined with respect to the insertion guide body 410, and the second insertion hole 440 may be provided to be perpendicular to the insertion guide body 410.

In the present embodiment, as shown in FIG. 5, a thread 450 may be provided on the outer wall of the insertion guide body 410 so that the support cap 140 may be screwed to the insertion guide body 410.

Figure 7:
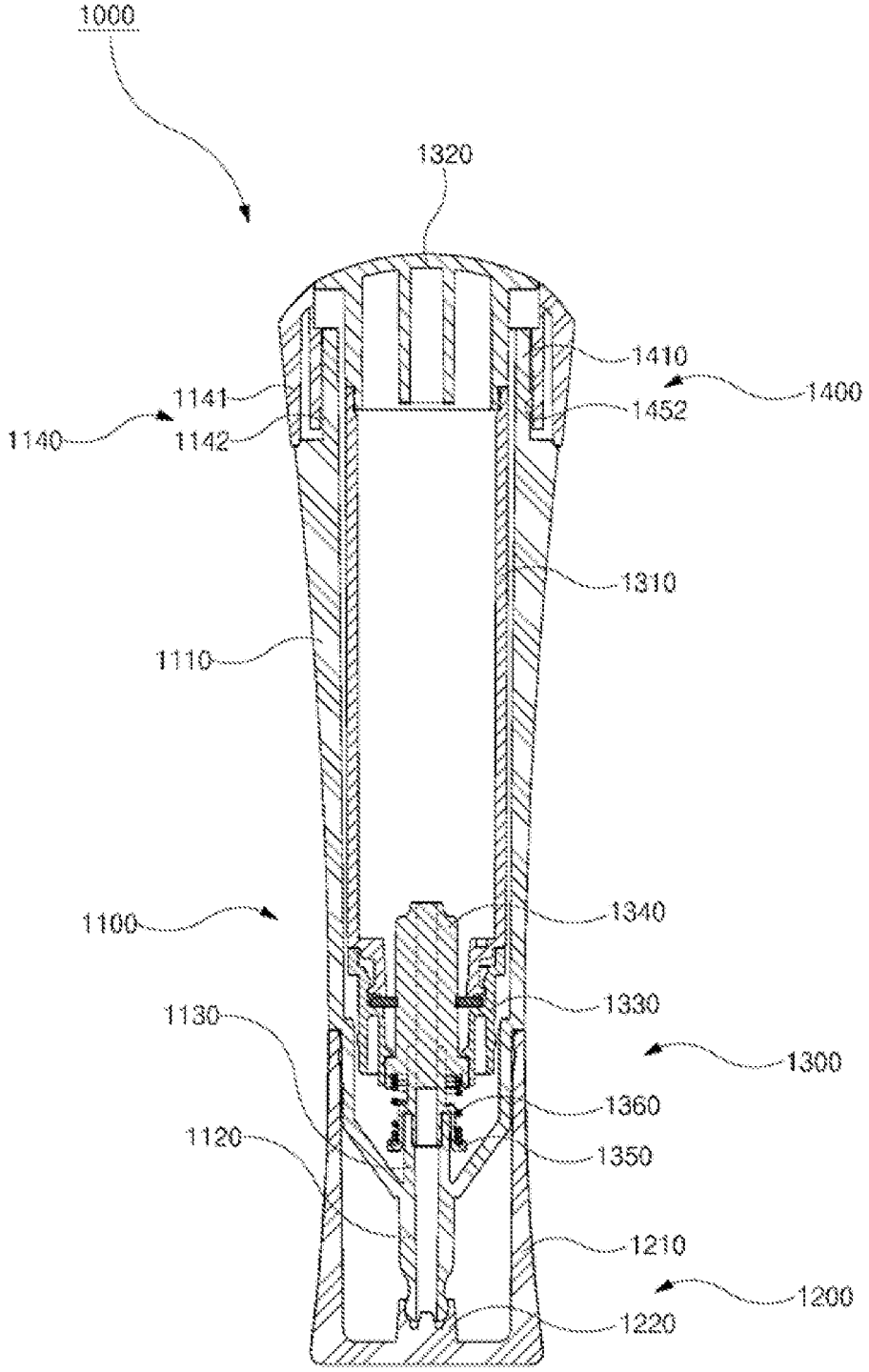
FIG. 7 is a cross-sectional view showing a refillable cosmetic container according to another embodiment of the present invention.
Figure 8:
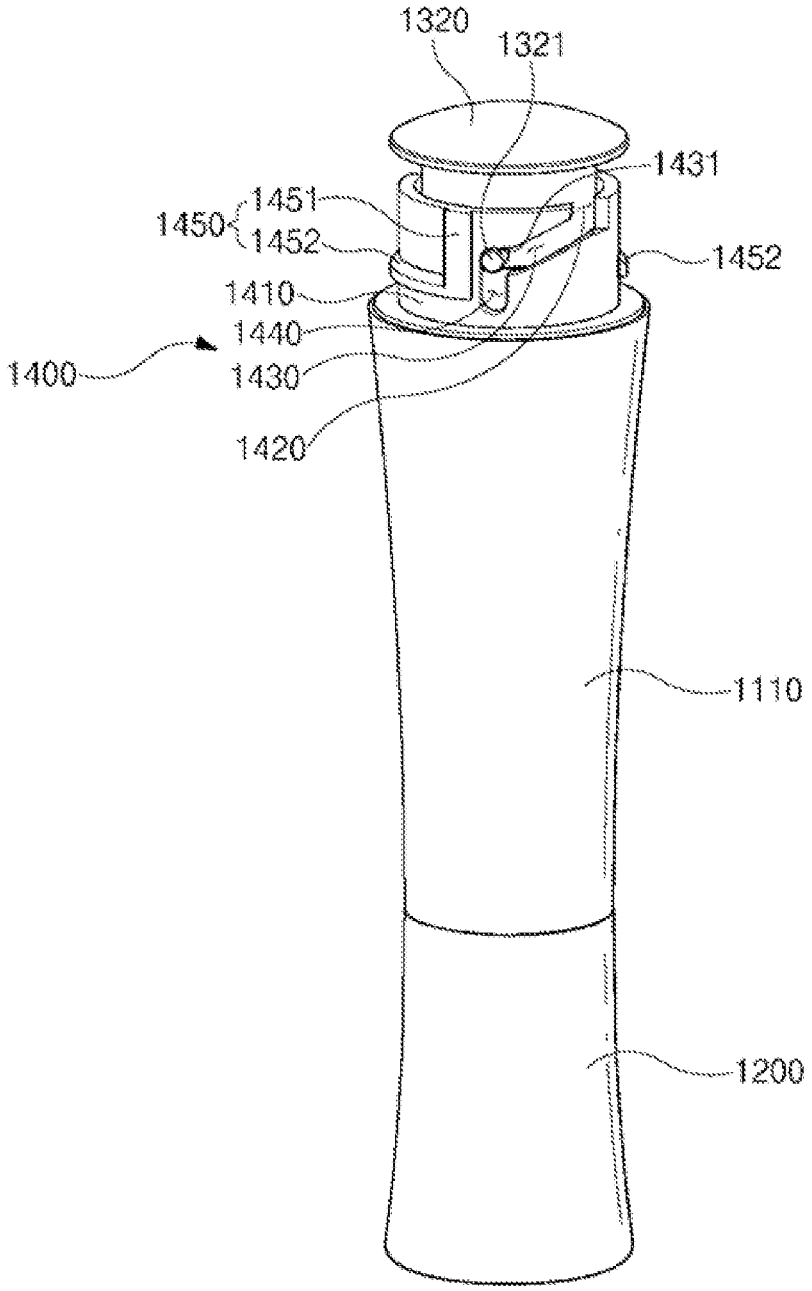
FIG. 8 is a perspective view showing a state in which a support cap is removed in FIG. 7.
Figure 9:
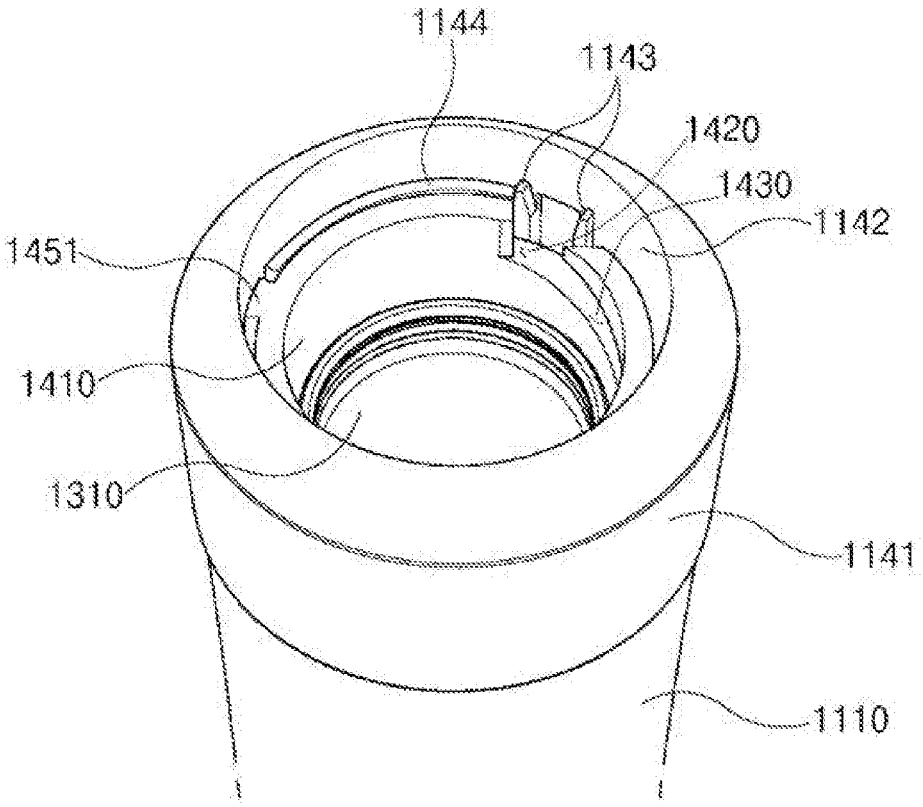
FIG. 9 is a perspective view showing a state in which the support cap shown in FIG. 7 is coupled to an insertion guide portion.
Figure 10:
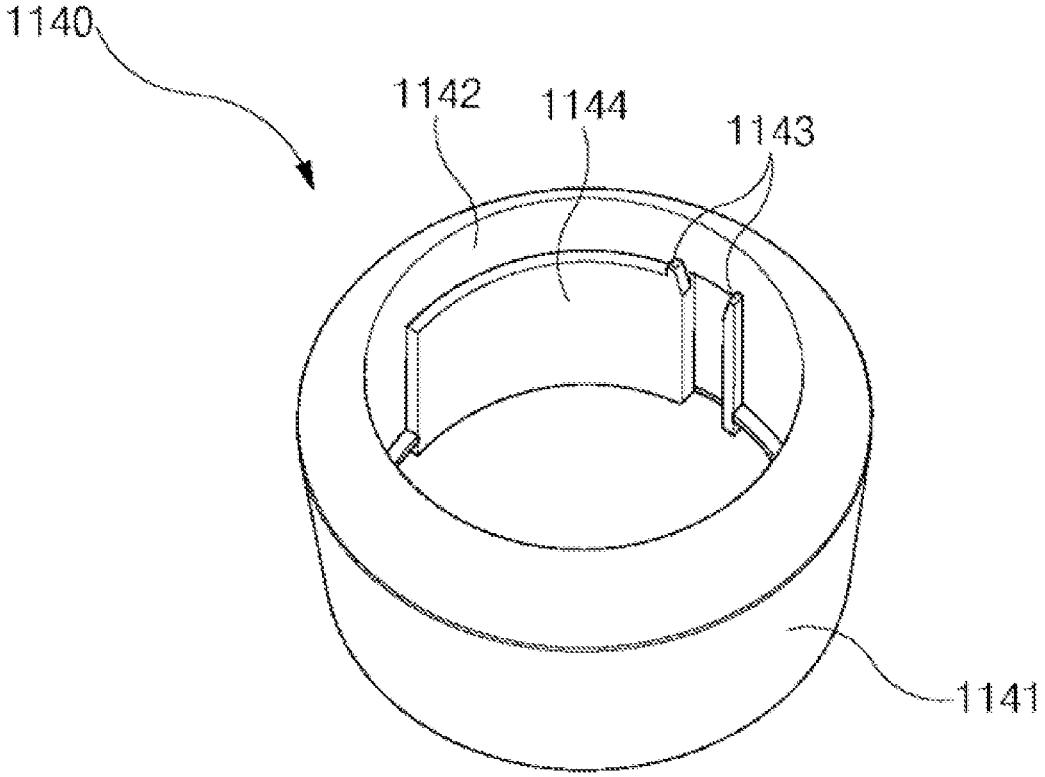
FIG. 10 is a perspective view showing the support cap shown in FIG. 9.
Figure 11:
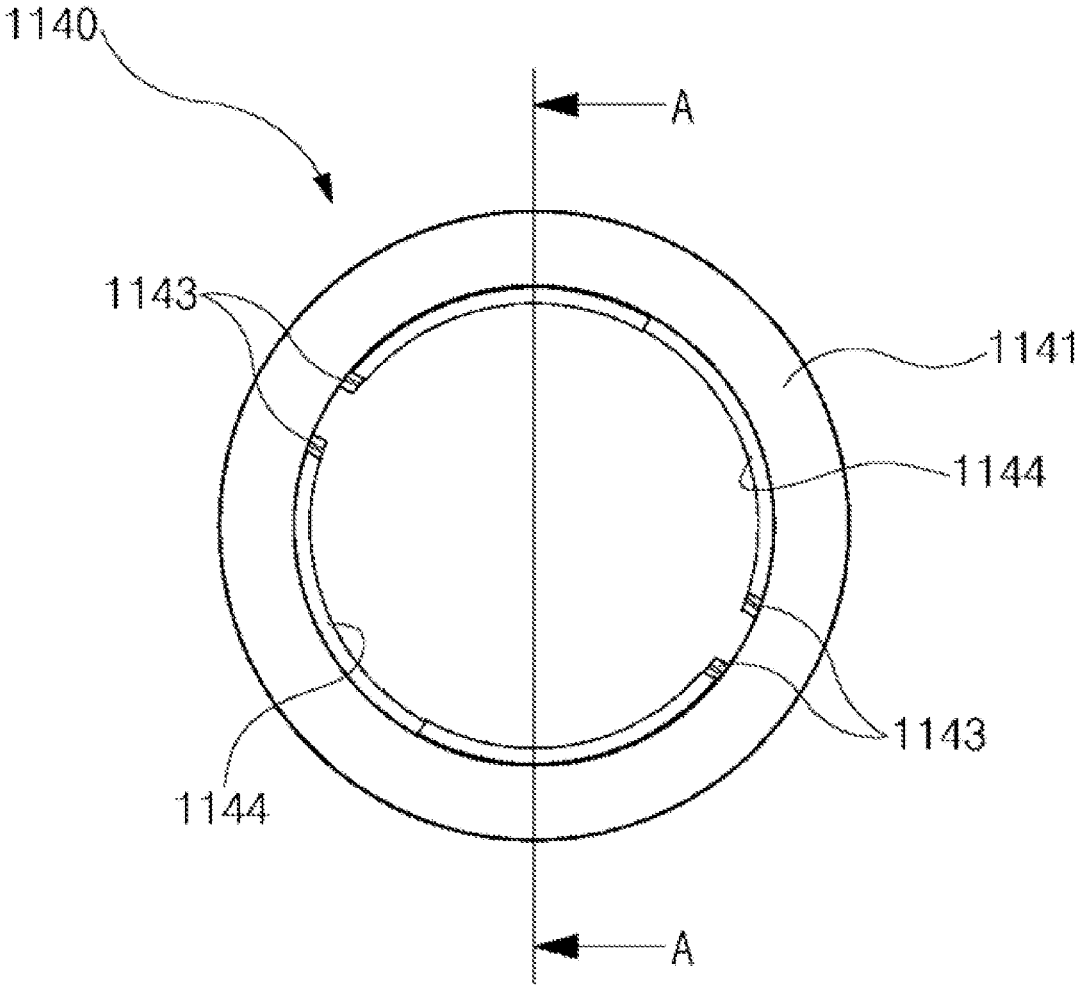
FIG. 11 is a plan view of FIG. 10.
Figure 12:
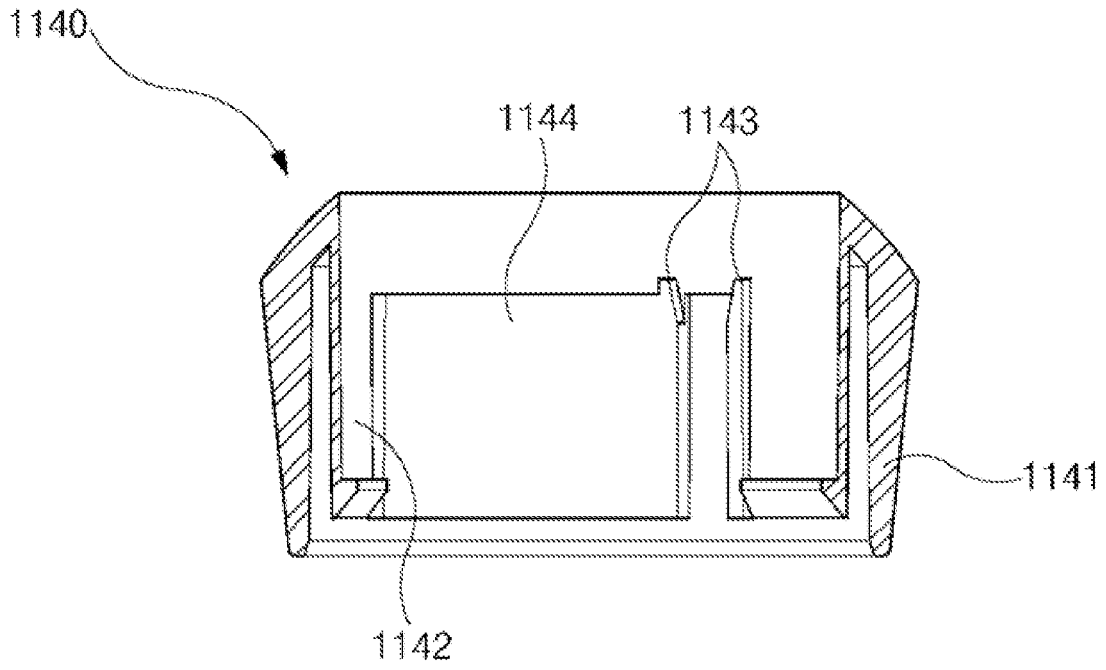
FIG. 12 is a cross-sectional view taken along the line A-A in FIG. 11.

FIG. 7 is a cross-sectional view showing a refillable cosmetic container according to another embodiment of the present invention, FIG. 8 is a perspective view showing a state in which a support cap is removed in FIG. 7, FIG. 9 is a perspective view showing a state in which the support cap shown in FIG. 7 is coupled to a pull-in guide portion, FIG. 10 is a perspective view showing the support cap shown in FIG. 9, FIG. 11 is a plan view of FIG. 10, and FIG. 12 is a cross-sectional view taken along the line A-A in FIG. 11.

As shown in these drawings, a refillable cosmetic container 1000 according to the present embodiment includes a container main body 1100, a main body cap 1200 detachably coupled to the container main body 1100, a refill container portion 1300 detachably coupled to container main body 1100 and storing cosmetics therein, and an insertion guide portion 1400 provided on the other side of a container body 1110 to guide the insertion of the refill container portion 1300.

As shown in FIG. 7, the container main body 1100 includes a container body 1110 having upper and lower openings, a cosmetic discharging member 1120 provided at the lower side of the container body 1110 and provided as a discharge passage of the cosmetics, a connector member 1130 which is provided inside the container body 1110 in a region where the cosmetic discharging member 1120 is provided and provided as a coupling place of a stem 1350, and a support cap 1140 which is detachably coupled to the insertion guide body 1410 to surround the refill container cap 1320.

The container body 1110 of the container main body 1100 may be provided in a circular shape elongated in a longitudinal direction as shown in FIG. 8.

As shown in FIG. 7, the cosmetic discharging member 1120 of the container main body 1100 may be fitted to a sealing cap 1220 to seal the opening portion and may be fixed to the sealing cap 1220.

The support cap 1140 of the container main body 1100 is coupled to a fastening portion 1450 provided on the outer wall of the insertion guide body 1410 shown in FIG. 8 to guide the refill container portion 1300 to be inserted into the input guide portion 1400.

In the present embodiment, as shown in FIGS. 10 and 12, the support cap 1140 includes an outer wall body 1141 provided in a circular shape, an inner wall portion 1142 extending from the outer wall body 1141 and spaced apart from the outer wall body 1141, a pair of guide posts 1143 provided on at least one on the inner wall of the inner wall body 1142 to guide the insertion of the stopper rod 1321, and a support wall 1144 extending from one of the pair of guide posts 1143 to support the fastening portion 1450 of the insertion guide portion 1400.

In the present embodiment, as shown in FIG. 9, the pair of guide posts 1143 may be provided at positions facing the insertion holes 1420, and a space is provided between the pair of guide posts 1143 to be provided as an insertion place of the stopper rod 1321 of the refill container portion 1300.

In the present embodiment, as shown in FIG. 11, two pairs of guide posts 1143 may be provided.

In addition, in the present embodiment, as shown in FIG. 7, a horizontal member 1452 of the insertion guide portion 1400 comes into contact with the support wall 1144 so that the support cap 1140 may be coupled to the insertion guide portion 1400.

Also, in the present embodiment, as shown in FIG. 7, the lower end of the outer wall body 1141 of the support cap 1140 may be supported in a groove provided at the upper edge of the container body 1110.

As shown in FIG. 7, the main body cap 1200 includes a cap body 1210 detachably fitted to a lower portion of the container body 1110 by protrusions and grooves, and a sealing cap 1220 provided on the inner wall of the cap body 1210 to fix and seal the end portion of the cosmetic discharging member 1120.

In the present embodiment, the lower portion of the cap body 1210 may be provided flatly, as shown in FIG. 7, so that the present embodiment may be vertically erected.

As shown in FIG. 7, the refill container portion 1300 is coupled to the container main body 1100 and the cosmetics stored in the refill container portion 1300 may be discharged to the outside of the container main body 1100 through the cosmetic discharging member 1120.

In the present embodiment, the refill container portion 1300 may be easily inserted into the container body 1110 through the insertion guide unit 1400 shown in FIG. 8 and the inserted position may be stably maintained.

In the present embodiment, as shown in FIG. 7, the refill container portion 1300 includes a refill container body 1310 in which the cosmetics are stored, a refill container cap 1320 which is detachably coupled to an upper portion of the refill container body 1310 and has a stopper rod 1321 provided on the outer wall, a pump inner cap 1330 coupled to a lower portion of the refill container body 1310; a pump housing 1340 coupled to the pump inner cap 1330; a stem 1350 of which a lower portion is coupled to a connector member provided in the container body 1110 and an upper portion is supported to the pump housing 1340, and a spring 1360 of which a lower portion is supported to the stem 1350 and an upper portion is supported to the pump housing 1340.

A pair of stopper rods 1321 of the refill container portion 1300 may be provided to be spaced apart from each other, and may be sequentially inserted to the first insertion hole 1430 and the second insertion hole 1440 through the insertion groove 1420 shown in FIG. 8.

The refill container cap 1320 of the refill container portion 1300 may be detachably screwed or fitted to the refill container body 1310.

The pump inner cap 1330 of the refill container portion 1300 may be detachably screwed or fitted to the refill container body 1310 or may be integrally formed with the refill container body 1310.

The pump housing 1340 of the refill container portion 1300 may be detachably screwed or fitted to the inner wall of the pump inner cap 1330.

As shown in FIG. 8, the insertion guide portion 1400 is provided at the upper portion of the container body 1110 and serves to guide the movement of the refill container portion 1300 when the refill container portion 1300 is inserted into or withdrawn from the container body 1110.

In the present embodiment, as shown in FIG. 8, the insertion guide portion 1400 includes an insertion guide body 1410 provided at the upper portion of the container body 1110, a pair of insertion holes 1420 provided on the inner wall of the upper end of the insertion guide body 1410 to guide the insertion of the stopper rod 1321 of the refill container portion 1300, a pair of first insertion holes 1430 provided in the guide body to be connected to the pair of insertion holes 1420 to guide the insertion of the stopper rod 1321, and a second insertion hole 1440 provided in the guide body to extend from the first insertion hole 1430 to fix the inserted stopper rod 1321.

In the present embodiment, as shown in FIG. 8, the first insertion hole 1430 is inclined with respect to the insertion guide body 1410, and the second insertion hole 1440 may be provided to be perpendicular to the insertion guide body 1410.

In the present embodiment, as shown in FIG. 8, on the outer wall of the insertion guide body 1410, a fastening portion 1450 is provided, and the support cap 1140 may be coupled to the insertion guide body 1410.

In the present embodiment, as shown in FIG. 8, the fastening portion 1450 includes a vertical member 1451 provided on the outer wall of the insertion guide body in a height direction of the container body 1110, and a horizontal member 1452 provided vertically to the vertical member 1451 at the lower end of the vertical member 1451.

In the present embodiment, as shown in FIG. 9, the vertical member 1451 is hooked on a side wall end portion of the support wall 1144, and in the present embodiment, a pair of vertical members 1451 and a pair of support walls 1144 are provided, respectively, so that each vertical member 1451 is supported on each support wall 1144, and as a result, the support cap 1140 may be fixed to the insertion guide body 1410 without distortion.

In the present embodiment, as shown in FIG. 7, the horizontal member 1452 comes into frictional contact with the inner wall of the support wall 1144 to fix the support cap 1140 so that the support cap 1140 may be detachably coupled to the insertion guide body 1410.

The present invention is not limited to the exemplary embodiments described herein, and it would be apparent to those skilled in the art that various changes and modifications might be made without departing from the spirit and the scope of the present invention. Therefore, it will be determined that the changed examples or modified examples are included in the appended claims of the present invention.

What is claimed is:

1. A refillable cosmetic container comprising:

a container main body including a container body having upper and lower openings and a cosmetic discharging member provided at a lower side of the container body and provided as a discharge passage of cosmetics;

a main body cap detachably coupled to the container main body in a region where the cosmetic discharging member is provided;

a refill container portion detachably coupled to the container main body and storing the cosmetics therein; and an insertion guide portion provided on an other side of the container body to guide insertion of the refill container portion, wherein the insertion guide portion includes an insertion guide body provided at the other side of the container body, at least one insertion groove provided on an inner wall of an upper end of the insertion guide body to guide insertion of a stopper rod of the refill container portion, a first insertion hole provided in the guide body to be coupled to at least one insertion groove to guide the insertion of the stopper rod, and a second insertion hole provided in the guide body to extend from the first insertion hole to fix the stopper rod.

2. The refillable cosmetic container of claim 1, wherein the first insertion hole is inclined with respect to the insertion guide body, and the second insertion hole is provided to be perpendicular to the insertion guide body.

3. The refillable cosmetic container of claim 1, wherein the refill container portion includes:

a refill container body in which the cosmetics are stored;

a refill container cap which is detachably coupled to one side of the refill container body and has the stopper rod provided on an outer wall;

a pump inner cap coupled to the other side of the refill container body;

a pump housing coupled to the pump inner cap;

a stem of which one side is coupled to a connector member provided in the container body and the other side is supported to the pump housing; and a spring of which one side is supported to the stem and the other side is supported to the pump housing.

4. The refillable cosmetic container of claim 1, wherein the main body cap includes:

a cap body detachably coupled to the container body; and a sealing cap provided on an inner wall of the cap body and fitted with an end portion of the cosmetic discharging member.

5. The refillable cosmetic container of claim 1, wherein the container main body further includes:

a support cap detachably coupled to the insertion guide body to surround a refill container cap.

6. The refillable cosmetic container of claim 1, wherein a stopper protrusion stopping the stopper rod provided in the refill container portion is provided in the first insertion hole.

7. A refillable cosmetic container comprising:

a container main body including a container body having upper and lower openings and a cosmetic discharging member provided at a lower side of the container body and provided as a discharge passage of cosmetics;

a main body cap detachably coupled to the container main body in a region where the cosmetic discharging member is provided;

a refill container portion detachably coupled to the container main body and storing the cosmetics therein; and an insertion guide portion provided on an other side of the container body to guide insertion of the refill container portion, wherein the insertion guide portion includes an insertion guide body provided at the other side of the container body, at least one insertion hole provided on an inner wall of an upper end of the insertion guide body to guide insertion of a stopper rod of the refill container portion, a first insertion hole provided in the guide body to be coupled to at least one insertion hole to guide the insertion of the stopper rod, and a second insertion hole provided in the guide body to extend from the first insertion hole to fix the stopper rod, and a pair of guide posts guiding the refill container portion to be inserted to the insertion guide portion is at least one provided in a support cap of the container main body.

8. The refillable cosmetic container of claim 7, wherein the pair of guide posts is provided on an inner wall body of the support cap, and a support wall extending from one of the pair of guide posts to support a fastening portion of the insertion guide portion is provided in the inner wall body.

9. The refillable cosmetic container of claim 7, wherein the pair of guide posts is provided at a position facing the at least one insertion hole.

10. The refillable cosmetic container of claim 7, wherein the first insertion hole is inclined with respect to the insertion guide body, and the second insertion hole is provided to be perpendicular to the insertion guide body.

11. The refillable cosmetic container of claim 7, wherein the main body cap includes:

a cap body detachably coupled to the container body; and a sealing cap provided on an inner wall of the cap body and fitted with the end portion of the cosmetic discharging member.

* * * * *